United States Patent [19]

Panetti

[11] Patent Number: 4,541,182

[45] Date of Patent: Sep. 17, 1985

[54] MEASURING DEVICE OF THE TRANSVERSE PROFILE OF THE HEAD OF A RAIL

[75] Inventor: Romolo Panetti, Geneva, Switzerland

[73] Assignee: Speno International S.A., Geneva, Switzerland

[21] Appl. No.: 559,876

[22] Filed: Dec. 9, 1983

[30] Foreign Application Priority Data

Dec. 27, 1982 [CH] Switzerland ..... 7557/82

[51] Int. Cl.[4] ..... G01B 7/28

[52] U.S. Cl. ..... 33/560; 33/175

[58] Field of Search ..... 33/1 Q, 174 P, 174 PA, 33/174 PB, 203.11, 174 R, 174 L, 175; 73/146, 105

[56] References Cited

U.S. PATENT DOCUMENTS

| | | | |
|---|---|---|---|
| 941,297 | 11/1909 | Barthelmes | 33/175 |
| 4,069,590 | 1/1978 | Effinger | 33/1 Q X |
| 4,288,855 | 9/1981 | Panetti | 73/146 X |
| 4,288,926 | 9/1981 | Long et al. | 33/174 P |

FOREIGN PATENT DOCUMENTS 606616 11/1978 Switzerland .

*Primary Examiner*—Harry N. Haroian

*Attorney, Agent, or Firm*—Young and Thompson

[57] ABSTRACT

The measuring device comprises a carrying frame (7) guided by the rails (2, 2') and driven along it through a railroad vehicle to which it is connected through the intermediary of hinges enabling a vertical and lateral displacement of said frame (7) with respect to the vehicle. The carrying frame (7) is provided with a plurality of feelers, cooperating with the surface of the head (12) of the rail (2) transversally spaced apart the ones from the other. The carrying frame (7) comprises a guiding dihedral used as reference base, the edge of which is parallel to the longitudinal axis of the rail (2), applied against the upper part of the rolling surface of the rail (2) and the lower part of the internal face of the head (12) of the rail. This guiding dihedral (2) carries at least one hinging shaft (21) which extends parallely to the edge of the guiding dihedral (2) on which at least two mechanical feelers (16,17) are pivoted, said feelers contacting the rail (2) in a measuring zone extending transversely to the surface of the head (12) of the rail.

17 Claims, 10 Drawing Figures

FIG. 8
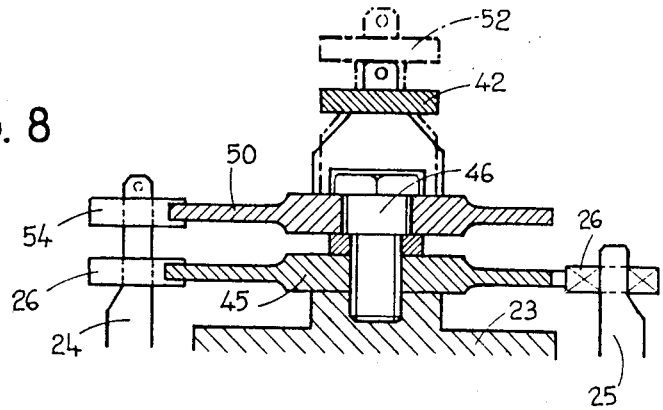
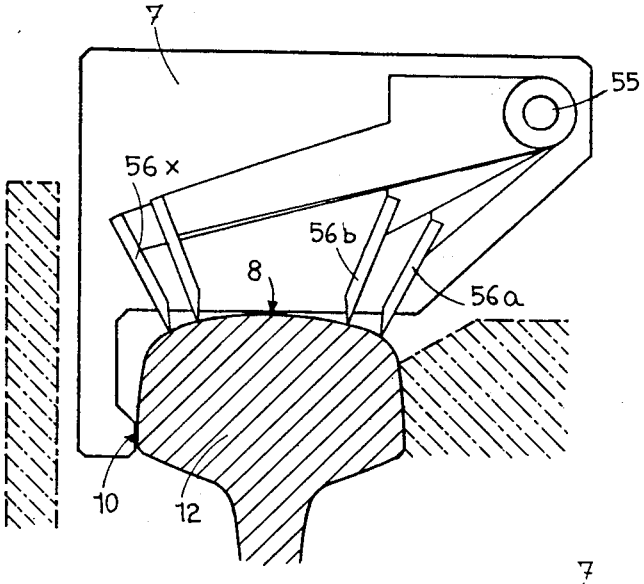
FIG. 9
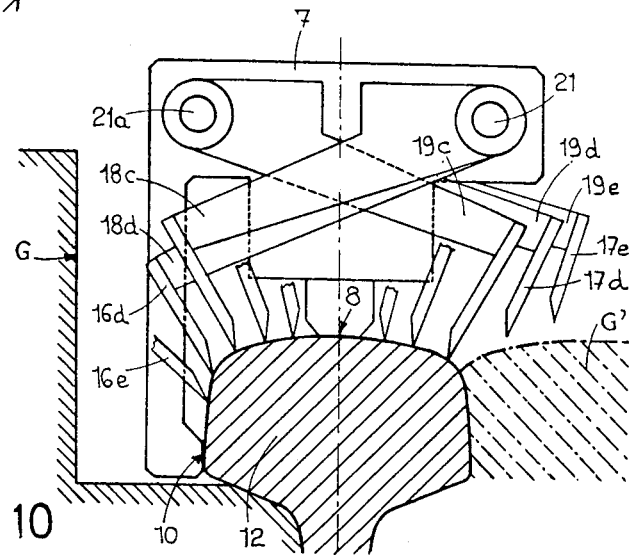
FIG. 10

MEASURING DEVICE OF THE TRANSVERSE PROFILE OF THE HEAD OF A RAIL

The present invention relates to the continuous on track measurement of the transverse profile of the useful portion of the head of a rail of a railroad track. By means of usuable portion of the head of the rail one intends the one on which the vehicle wheels rest and particularly the rolling surface, the rounded side portions and the upper part of the inside face of the rail.

The development of the on track reprofiling machines of the rails, by grinding or planing shows the necessity to know at any time and at any points of the track the exact shape of the head of the rails to permit the precise adjustment of the working position of the reprofiling tools (grinding wheels, grinding blocs, planes, etc.) to adapt this position to the wearing state of the said head of the rail. Only this way it is possible to perfectly reconstitute the desired shape of the head of the rails without removing to much material, and to check the quality of the work done.

The Swiss patent No. 606,616 aimed to answer this needs and describes a measuring device comprising a plurality of feelers disposed side by side around the rolling table, the rounded edge and the inside face of the head of the rails, feelers the movements of which with respect to a supporting carriage guided along the rails and used as reference base, are detected by known measuring detectors, able to deliver an output signal proportional to the said displacement of the feelers. The detectors used in particular are note described in this patent, but are only shown very schematically. In fact, the feelers known at the date of publication of the said patent where very cumbersome, their mounting side by side in a same transverse plan of the rail showed such difficulties that it was not possible to have a sufficient number to obtain a sound measurement of the shape of the head of a rail.

The present measuring device according to the invention tends to remedy this main drawback of the existing devices and distinguishes itself by the characteristics recited in claim 1.

The device according to the invention has the advantage to enable the measurement in a same plan perpendicular to the axis of the rail of a sufficient number of side lines to obtain a complete and exact image of the rolling surface, of the rounded edges of the rail and of the upper part of the inside face of this rail.

Furthermore this relatively simple mechanical solution takes less space so that even when working it does not conflict with the standard free obstacle gauge and enables thus a continuous measurement even in the track apparatuses.

Finally the possibility to mount the same number of feelers symmetrically with respect to the axis of the rails permits if desired to measure the outside edge and the upper part of the outside face of the rail. In this embodiment, the necessary supplemental feelers for said measurement of the outside part of the rail are retractable independently from the other feelers to avoid obstacles which can be present along the track.

The attached drawing shows schematically and by way of example several embodiments of the measuring device according to the invention.

FIG. 8 is a partial cross section of the retracting system of the feelers.

FIGS. 9 and 10 show variants of the mechanical feeler assemblies.

Figure 1:
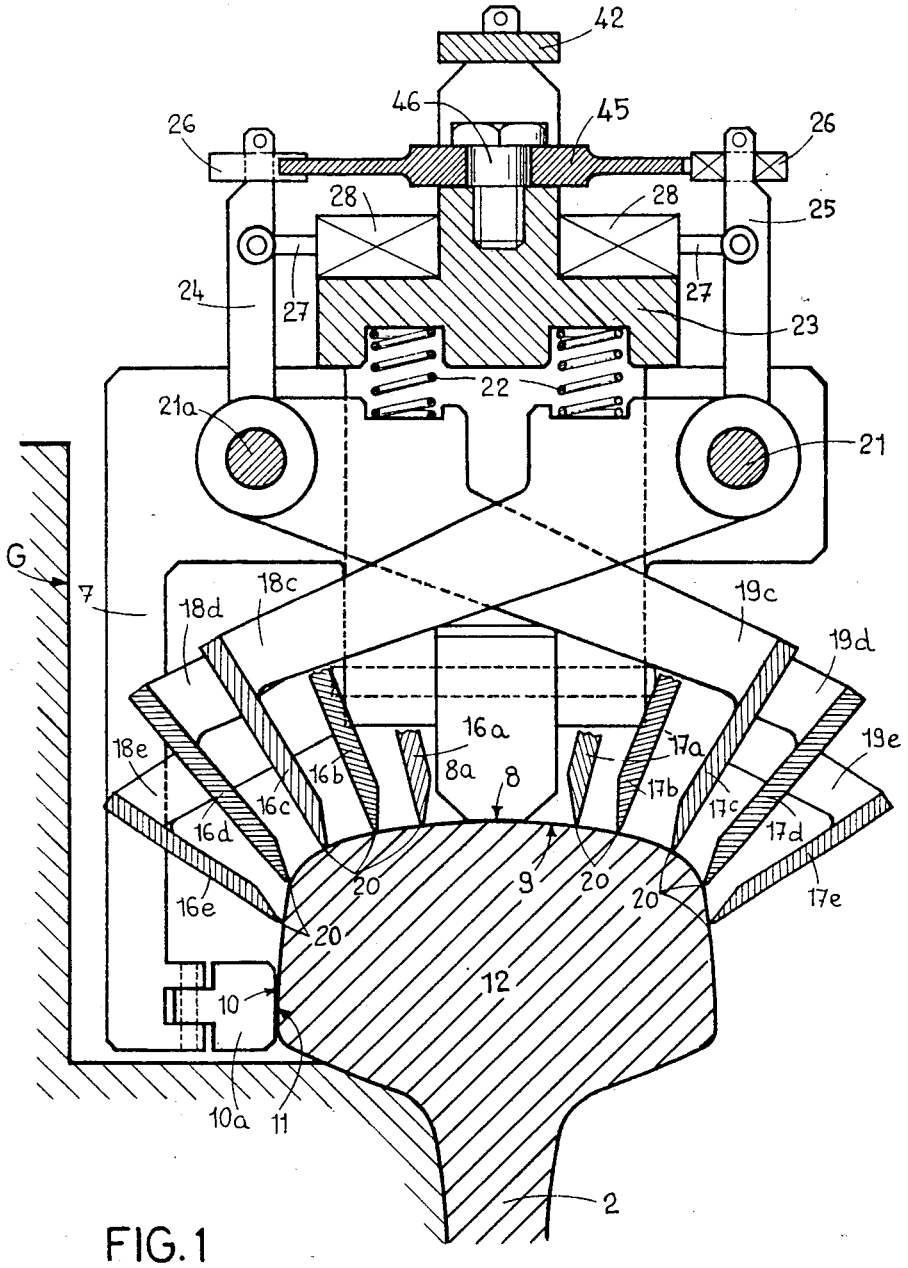
FIG. 1 is a transversal cross-section of a mechanical feeler assembly cooperating with a rail.
Figure 2:
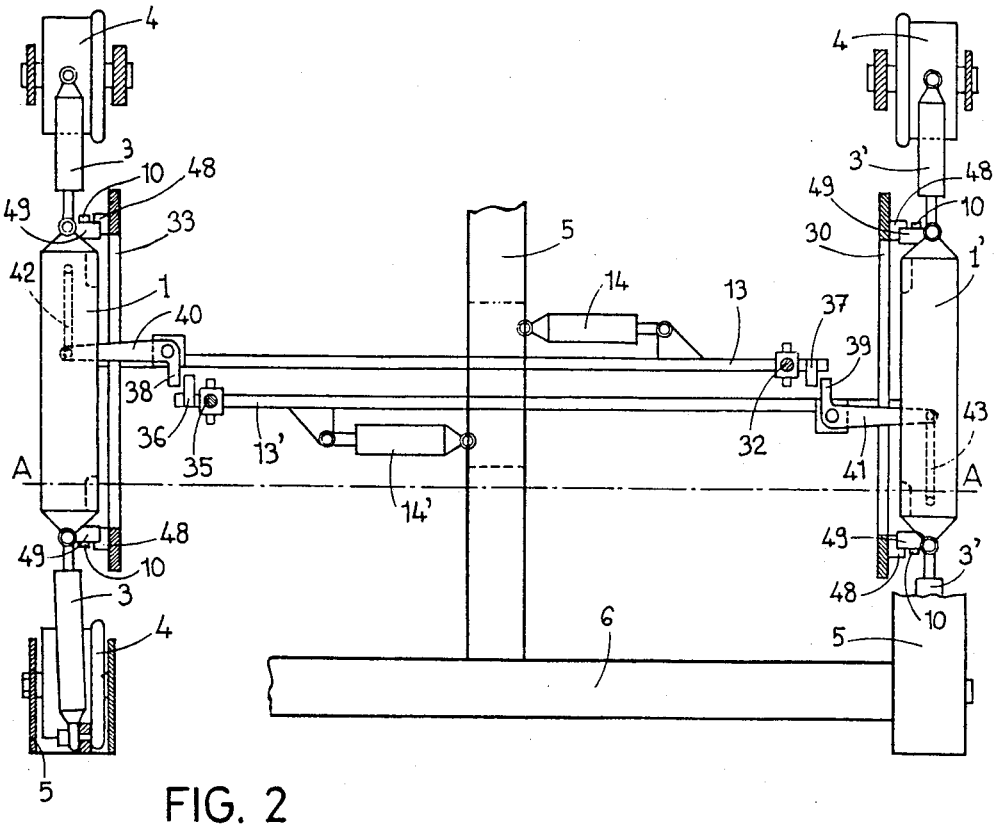
FIG. 2 is a top view of the measuring device comprising, mounted on a supporting frame two mechanical feeler assemblies each cooperating with one line of rail.
Figure 3:
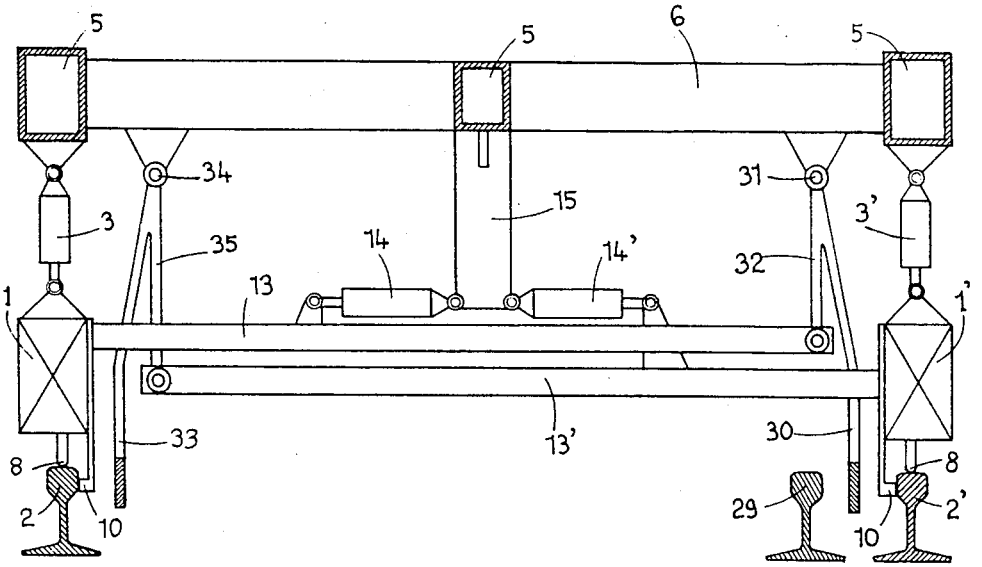
FIG. 3 is a transversal cross-section of the device along line A—A of FIG. 2.
Figure 4:
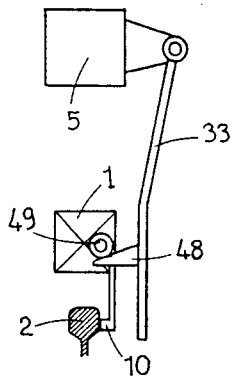
FIGS. 4 and 5 show schematically a lifting device of the totality of a feeler assembly.
Figure 5:
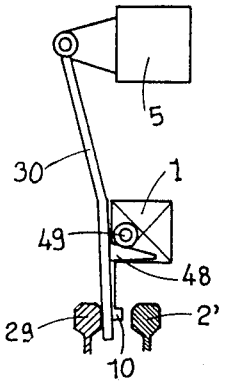

In the example shown, two measuring devices 1, each associated to one of the lines of rails 2, 2' of a railroad track are mounted by means of jacks 3, 3' on a carriage comprising flanged wheels 4 resting on the rails. This carriage formed of beams 5 and crossmembers 6 is linked to a railroad vehicle for its displacement along the railway track. Each device is hinged on the carriage in order to be able to displace itself laterally and vertically with respect to said carriage.

Each measuring device 1, 1' comprises a guiding frame formed of a guiding dihedral 7 comprising a horizontal bearing face 8 intended to contact, in service position, the central zone of the rolling table 9 of the rail and a vertical bearing face 10 intended to contact, again in service position, the lower part of the inside lateral face 11 of the head 12 of the rail 2. This dihedral forms a reference base for the measurement of the rail profile and the bearing faces 8, 10 can be assimilated to measuring feelers used to determine the transverse profile of the rail. The bearing faces 8, 10 are preferably carried by shoes or slides 8*a*, 10*a* respectively, hinged, along axes extending perpendicularly to the longitudinal axis of the rail, on the dihedral 7.

Each measuring device 1, 1' is further fast with a beam 13, 13' linked by means of a jacks 14, 14' to a support 15 fast with the carriage 5, 6.

Therefore in service position, each measuring device 1,1' is applied vertically and laterally against the rail through the bearing faces 8, 10 of the frame 7 with a force which is determinated by the action of the jacks 3, 3'; 14, 14'.

Thus each frame or dihedral 7, the edge of which is, in service position, parallel to the longitudinal axis of the rail, constitutes a reference base, precisely guided by the rail 2 itself, for the measurement of the transverse profile of the rail and its interpretation.

The dihedral or frame 7 serves as support for an assembly of mechanical feelers 16, 16*a* . . . 16*e* and 17*a* . . . 17*e* each comprising a pin-point contact member 20 intends to contact the surface of the head 12 of the rail in a narrow area, transverse with respect to the rail 2, but preferably all located in a same plan perpendicular to the longitudinal axis of the rail. Each contact member 20, as well as the bearing faces 8,10 rest in service position, on a different side line of the head of the rail. The number of feelers 16, 17 is such, for example comprised between 6 and 12, that it enables to measure a sufficient number of side lines to exactly reconstitute the shape of this profile. In the embodiment shown at FIG. 1, the ten feelers 16, 17 are uniformly distributed on the whole periphery of the head of the rail, i.e. its rolling table and its inner and outer side edges, as well as the upper part of the inside flange of the head of the rail.

Figure 6:
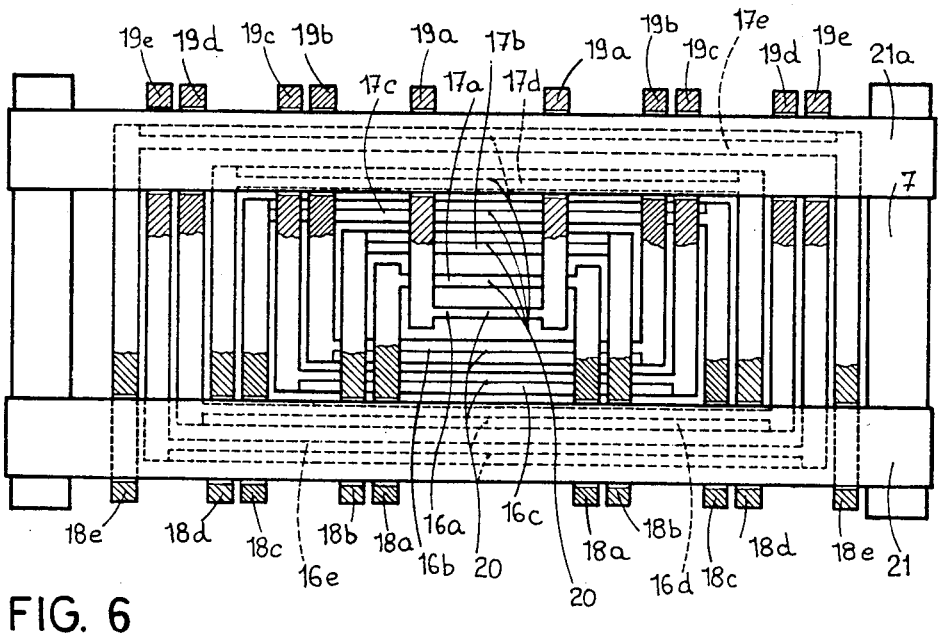
FIG. 6 is a partial top view of a mechanical feeler assembly.
Figure 7:
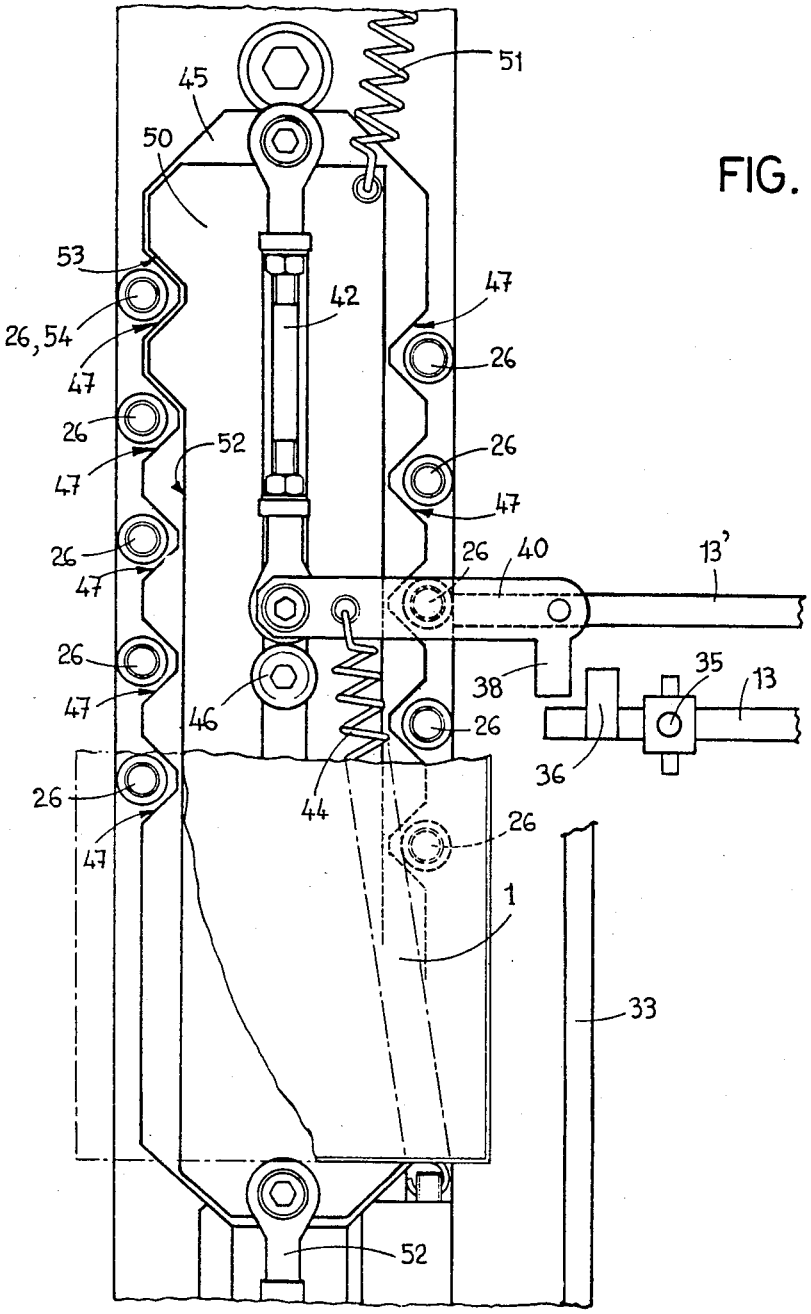
FIG. 7 is a partial top view of a feeler assembly showing the retracting system of the mechanical feelers.

Each mechanical feeler 16, 17 is carried by two arms 18, respectively 19, pivoted on two shafts 21, 21*a* respectively, fast with the frame 7 and extending parallely to the longitudinal axis of the rail 2 when the frame 7 is in service position guided by its shoes 8,10 on the rail. As can be seen in FIG. 6, the arms of the feelers 16, 17 are imbricated the ones in the others forming thus a very compact assembly, less cumbersome and permitting to locate all pin-point contact members 20 in a same plan extending perpendicularly to the longitudinal axis of the rail. In this example, the feelers are imbricated pairwise, but in other examples not shown, the feelers could be individually imbricated the ones into the others.

Each feeler is submitted to the action of at least one spring 22, tending to maintain its pin-point contact member 20 in contact with the surface of the head of the rail. These springs 22 are for example compression springs bearing on the one hand on a bloc 23 fast with the frame 7 and on the other hand on one of the arms 18, 19 of a feeler.

The arms 18, 19 of each feeler are fast with a control lever 24, respectively 25, extending vertically above the frame 7 and the upper end of these levers is provided with a roller 26 mounted on ball bearing. Each lever 24, 25 is connected to the movable member 27 of a detector 28 transforming the angular displacements of these levers 24, 25 in electrical signals proportional to the displacements of the feeler and which are therefore representing the position of the contact point 20 of the feeler 16, 17 with the surface of the head 12 of the rail 2.

The entirety of this mechanical measuring device is very compact and can be placed inside the free obstacle standard gauge G of the track.

Thanks to this measuring device which is purely mechanical one can measure the exact profile, by means of 6 to 12 measuring points for example, of a transverse crosssection of the useful portion of the head of the rail formed by rolling table and the inside and outside side edges as well as the upper part of the inside flange of the head of the rail. In the example shown one has twelve measuring points located on different side lines of the head of the rail, ten mechanical feelers 16, 17 and the two bearing surfaces 8, 10 of the frame 7.

Thanks to the small size of the measuring device it is located inside the free track standard gauge G and can thus be displaced along whole the length of a railroad track.

When the device has to be set out of order for a high speed displacement of the vehicle or to avoid accidental obstacles, it is lifted by means of the jacks 3, 3'.

In order to pass the rails of the switching points without trouble, the shown device is provided with an automatic retractable system for the feelers 16, 17 controlled by the presence of a counter rail 29.

This automatic retracting device comprises a control member 30 the lower part of which is intended to cooperate with a counter-rail 29, hinged on a crossmember 6 of the carriage in 31 and fast with a lever 32 hinged on the beam 13. In the same manner, this system comprises a second actuating member 33 intended to cooperate with a counter-rail associated to the other line of rails, also pivoted, in 34, on the crossmember 6 of the carriage and fast with a lever 35 hinged on the beam 13'.

Therefore when during the displacement of the carriage along the railway track, one of the control members 30, 33 is displaced under the action of a counter-rail, towards the outside of the track, i.e. in the direction of the rail 2, 2' to which it is associated, it causes a relative displacement of the beams 13, 13' the one with respect to the other causing a reduction of the distance separating the measuring devices 1, 1' related to each of the lines of rails 2, 2'.

During the relative displacement of the beams 13, 13', parallely to their longitudinal axes, an abutment 36, fixed on the beam 13' and an abutment 37 fixed on the beam 13 enter in contact with the curved end 38, respectively 39 of an actuating lever 40, respectively 41, hinged on the beam 13, respectively 13'. Thereafter, always during this relative displacement of the beams 13, 13', the control levers 40, 41 are driven in rotation.

The end of the levers 40, 41 submitted to the action of springs 44, is connected through levers 42, 43 to control plates 45 of each measuring device 1, 1'.

Each control plate 45 is slidably mounted on the frame 7 of its measuring device by means of screws 46. The lateral edges of this plate 45 are provided with notches 47 in which are located, in rest position of the plate 45, the rollers 26 of the levers 24, 25 of the feelers 16, 17.

Therefore, during a rotation of the control levers 40, 41, caused by a relative linear displacement of the beams 13, 13', the sides of the notches 47 contact the rollers 26 and causes a pivotement of the feelers around the axes 21, 21*a* and therefore the retraction of the feelers 16, 17 which are then no more in contact with the head 12 of the rail 2.

On the other hand, the control members 30, 33 cause the lifting of the measuring device 1, 1' through a came 48 of these control members cooperating with an abutment 49 carried by the measuring device.

In that way, the feelers are retracted and the measuring devices are lifted automatically by the action of a counter-rail on the control members 30, 33 during the displacement of the carriage along the track. The contact of one of the control members 30, 33 with its associated counter-rail 29 hinders also that the measuring device penetrates laterally into the void of throwing points.

In the embodiment shown, the measuring device comprises further a manual retracting system for the feelers 17*d* and 17*e* entering in contact with the outside flange of the rail. These feelers 17*d* and 17*e* have to be selectively liftable to enable the passage of the working measuring device, the other feeler resting in contact with the rail, in the level crossings for example. This manual retracting system comprises a second control plate 50 slidably mounted on the frame 7 parallely to the first plate 45. This plate 50 is submitted to the action of a return spring 51 and to a lever 52 connected by a non illustrated linkage to a manual control member. One of the lateral edges of this plate 50 is provided with notches 52 one side of which cooperates with rollers 54 carried by the levers 24 of the feelers 17*d* and 17*e*. In this way, a displacement of said plate 50 enables to retract selectively the feelers 17*d* and 17*e* as shown schematically at FIG. 10.

It is also to be seen on said FIG. 10 that all the measuring device is located inside of the free track standard gauge G, G' when the two feelers 17*d* and 17*e* are retracted, the other feelers remaining in contact with the rail.

In the device just described, it comprises two axes 21, 21*a* for pivoting the feelers 16, 17 which are located symmetrically with respect to a vertical plan passing through the longitudinal axis of the rail 2. This is a particular case, these axes 21, 21*a* could as well be disposed dissymmetrically with respect to said plan.

In the embodiment shown schematically at FIG. 9, the measuring device comprises only one shaft 55, displaced with respect to the vertical plan passing through the longitudinal axis of the rail 2, around which all the feelers 56*a*, 56*b* . . . 56*x* are pivoted. Two at least of said feelers 56 are in contact with points of the surface of the head of the rail located on the other side of this vertical plan of the rail 2.

The measuring device comprises usually at least three feelers entering in contact with the rolling table of the rail and at least two feelers in contact with the inside edge and the upper inside flange of the rail. Preferably this device comprises further at least two feelers in contact with the outside edge of the rail.

Thanks to this purely mechanical measuring device the original concept of which permits the positionning of a great number of rail contacting elements in a same plan perpendicular to the axis of this rail, the transverse profile of a rail can be measured with a high precision. In fact 10 to 14 different side lines of the head of the rail can be simultaneously measured continuously without problems, Furthermore due to its reduced dimensions the whole track can be measured, the device being located inside the standard free track gauge. Finally thanks to the automatic retracting device of the feelers, they do not fall into the voids of throwing points.

It is to be noted that the hinged part or parts 8 forming the bearing surface of the dihedral 7 on the rail can simultaneously define a reference base for the measurement of the longitudinal undulations of the surface of the head of the rail. In fact the blocs 8*a* hinged on the dihedral 7 are located on either side of the group of feelers 16, 17 and this distance is sufficient to realize the reference base of a measuring device such as described for example in U.S. patent application Ser. No. 540,688 filed Oct. 11, 1983. Thus this very compact measuring device cannot only measure the transverse profile of a rail but also the longitudinal undulations, short or long, of its rolling table.

I claim:

1. Continuous on track measuring device of the transverse profile of the useful portion of the head of at least one rail of a railroad track comprising a bearing frame, guided by the rails, and pulled along them by means of a railroad vehicle to which it is connected through hinges permitting vertical and lateral displacements of said frame with respect to the vehicle, this bearing frame being provided with a plurality of feelers, cooperating with the surface of the head of the rail, displaced the ones with respect to the others transversely to the rail, characterized by the fact that the bearing frame comprises a guiding dihedral forming a rerefence base, the edge of which is parallel to the longitudinal axis of the rail, applied against the upper, portion of the rolling surface and against the lower portion of the internal face of the head of the rail; and by the fact that it comprises at least one hinging shaft parallel to the edge of the guiding dihedral on which are pivoted at least two mechanical feelers, measuring at least two different sidelines of the rail, provided with pin-point contact members intended to enter in contact with the rail in a measuring zone transverse to the surface of the head of the rail.

2. Device according to claim 1, characterized by the fact that the shaft on which the feelers are pivoted is laterally displaced on one side of the middle longitudinal plan of the rail and by the fact that the contacts of at least two of said feelers cooperate with points of the surface of the head of the rail located on the other side of said middle plan of the rail.

3. Device according to claim 2, characterized by the fact that it comprises two parallel shafts mounted on the bearing frame, located on either side of a vertical plan passing through the longitudinal axis of the rail, each of these shafts serving to pivot at least two mechanical feelers.

4. Device according to claim 3, characterized by the fact that each feelers comprises two arms, hinged on said shafts, the free ends of which are connected through a bar on which is fixed the contact member.

5. Device according to claim 4, characterized by the fact that the feelers hinged on the same shaft are, seen from above, located the ones inside the others, and by the fact that the contact member of all the feelers are substantially aligned on the trace formed by the intersection of a plan perpendicular to the rail with the surface of the head of said rail.

6. Device according to claim 5, characterized by the fact that, seen from above, the arms of a feeler pivoted on one of the shafts are located between the arms of two feelers pivoted on the other shaft.

7. Device according to claim 5, characterized by the fact that, seen from above, the adjacent arms of two feelers pivoted on a same shaft are located between the arms of two feelers pivoted on the other shaft.

8. Device according to claim 4, characterized by the fact that it comprises at least three feelers the contact members of which cooperate with the rolling surface of the rail and at least two other feelers the contact member of which cooperates with the inside edge of the rail.

9. Device according to claim 8, characterized by the fact that it comprises further at least two feelers the contact member of which cooperates with the outside edge of the rail.

10. Device according to claim 8, characterized by the fact that it comprises lifting means of all the feelers simultaneously controlled by a same control member located on the path of a counter-rail.

11. Device according to claim 8, characterized by the fact that it comprises lifting means of all the feelers simultaneously controlled by a same control member located on the path of a counter-rail and by the fact that it comprises further retracting means of the feelers the contact member of which cooperates with the outside edge of the rail, controlled by a second control member independent from said other control member.

12. Device according to claim 1, characterized by the fact that the bearing frame is provided with vertical guiding pads, intended to rest on the rolling surface of the rail, located on either side of the group of feelers, and by the fact that these pads are hinged on the said bearing frame on axes extending perpendicularly to the longitudinal axis of the rail.

13. Device according to claim 12, characterized by the fact that the bearing frame is provided with lateral guiding pads, hinged on the said bearing frame on axes extending perpendicularly to the longitudinal axis of the rail, intended to enter in contact with the inside lateral face of the rail, located on either side of the group of feelers.

14. Device according to claim 10, characterized by the fact that it comprises two bearing frames each associated to one rail of a railway track, that it comprises spreading means tending to spread these frames apart and to apply the lateral guiding pads against the internal surface of each rail, and by the fact that the control member of the lifting means of each bearing frame is located on the path of a counter-rail associated to the rail cooperating with the other bearing frame.

15. Device according to claim 14, characterized by the fact that the control members of the lifting means of the feelers are provided with a cam cooperating with a lug fast with the guiding frame of the device causing simultaneously with the lifting of said guiding frame the retraction of said feelers.

16. Device according to claim 1 characterized by the fact that it comprises at least eight mechanical feelers, one of which at least being retractable independently from the others.

17. Device according to claim 13, characterized by the fact that it comprises two bearing frames each associated to one rail of a railway track, that it comprises spreading means tending to spread these frames apart and to apply the lateral guiding pads against the internal surface of each rail, and by the fact that the control member of the lifting means of each bearing frame is located on the path of a counterrail associated to the rail cooperating with the other bearing frame.

* * * * *